US006082541A

United States Patent [19]

Bewick

[11] Patent Number: 6,082,541

[45] Date of Patent: Jul. 4, 2000

[54] STACKABLE METAL CAN

[75] Inventor: Michael W. M. Bewick, Oakham, United Kingdom

[73] Assignee: Mars U.K. Limited, Slough, United Kingdom

[21] Appl. No.: 09/101,347

[22] PCT Filed: Jan. 6, 1997

[86] PCT No.: PCT/GB97/00025

§ 371 Date: Feb. 1, 1999

§ 102(e) Date: Feb. 1, 1999

[87] PCT Pub. No.: WO97/25251

PCT Pub. Date: Jul. 17, 1997

[30] Foreign Application Priority Data

| | | | |
|---|---|---|---|
| Jan. 4, 1996 | [GB] | United Kingdom | 9600088 |
| Jan. 4, 1996 | [GB] | United Kingdom | 9600089 |
| Aug. 19, 1996 | [GB] | United Kingdom | 9617365 |

[51] Int. Cl.[7] ..... B65D 21/036

[52] U.S. Cl. ..... 206/508; 220/619

[58] Field of Search ..... 220/508, 619, 220/729, 906, 620; 206/508, 501, 499

[56] References Cited

U.S. PATENT DOCUMENTS

| | | | |
|---|---|---|---|
| 2,759,628 | 8/1956 | Sokoloff | 220/619 |
| 3,272,671 | 9/1966 | Gaylord | 206/508 |
| 3,912,109 | 10/1975 | Essex, Jr. et al. | 220/608 |
| 5,169,017 | 12/1992 | Cooper et al. | 220/273 |
| 5,740,914 | 4/1998 | Herzog | 206/501 |

*Primary Examiner*—Stephen Castellano

[57] ABSTRACT

A stackable container has a peripheral skirt around its base which resiliently fits over a peripheral rim around the lid of a similar container to frictionally engage the container to enable stacking of the containers. When stacked the stack of containers may be processed in a conventional manner.

15 Claims, 1 Drawing Sheet

STACKABLE METAL CAN

BACKGROUND OF THE INVENTION

The invention relates to containers, and finds particular application in cans of human and animal food products.

Canned products are conventionally sold in single cans, or in bulk in shrink-wrapped trays of cans. Canned products are sometimes sold in so called multipacks of for example 3 or 4 cans, held together by shrink-wrapping or board.

Conventional cans may be able to sit stably one on top of another; however, they must be held together, such as by shrink wrapping, while being handled. Further, it is not currently possible to stack cans having ring pull openings, since a can may bear on a ring pull below, damaging the ring pull or causing the line of weakness around the can lid to fail. Currently, ring pull cans are transported in trays in single layers. This is expensive, particularly for small capacity cans, and means that the label on the can is largely obscured if the entire tray is placed on retail shelves.

Cans are generally of standard sizes. Conventionally, multipacks contain cans of one size only. Switching production from one size of can to another can cause delays in production, as machinery is altered to handle the new size of can.

SUMMARY OF THE INVENTION

The present invention provides a stackable container, several of which can be locked together to form a stable substantially rigid stack which can withstand handling during production and transport without being further secured. This is provided by a container, such as a can, having a lid carrying a substantially peripheral rim, a base, a side wall and a generally peripheral skirt around the base, preferably continuously, extending away from the container body adapted to resiliently fit over the rim of another similar container.

Preferably, the rim and the skirt are shaped to interlock when the skirt of one container is resiliently fitted over the rim of another similar container.

Preferably, the side wall is necked at the lid end so that the rim lies inside the perimeter defined by the side wall. Alternatively, the lower portion of the container is flared outward, so that the skirt can fit over the rim of another container.

Preferably, the skirt defines a channel on its inward facing side.

Preferably the container is a metal can, and particularly preferably a two piece container, such as a so called draw and redraw (DRD) can, in which the side wall and base are of one piece and the lid is of a second piece. In this case, the skirt is continuous with the side wall and the base, and the rim is the seal between the side wall and the lid.

In the case of cylindrical containers the skirt of one preferably fits over the rim of another with a friction fit as well as a resilient fit to prevent relative rotational movement of stacked containers.

The invention also provides a stack of at least two containers according to the invention.

The invention also provides a method of processing a plurality of containers in which the containers are stacked prior to being processed. Preferably, the process is adapted for containers of a first height and the containers to be processed are of a height or heights less than the first height in which the containers to be processed are stacked to a height substantially equal to the first height.

Containers according to the invention can be stacked together immediately after being filled and sealed so that subsequent production steps are carried out on the stack. This means that several smaller containers, for example, two 200 g cans, can be stacked together and processed in the same equipment as a single 400 g can, without alteration of the equipment.

BRIEF DESCRIPTION OF THE DRAWING

Containers according to the invention can be stacked prior to retail sale to allow multipacks to be provided without the need for shrink wrapping or other means to secure the containers together.

The stacks of containers can contain more than one variety of product and more than one size of container.

Different types of container can be stacked together; for example, a can of a wet product can be stacked with a container of a dry product. This is of particular advantage if the wet and dry products are complementary, such as products which are to be mixed together prior to serving.

If the skirt is a friction fit as well as a resilient fit over the rim, the containers of the stack can be labelled in one operation, with separate labels which will not subsequently move out of alignment with each other.

Figure 1:
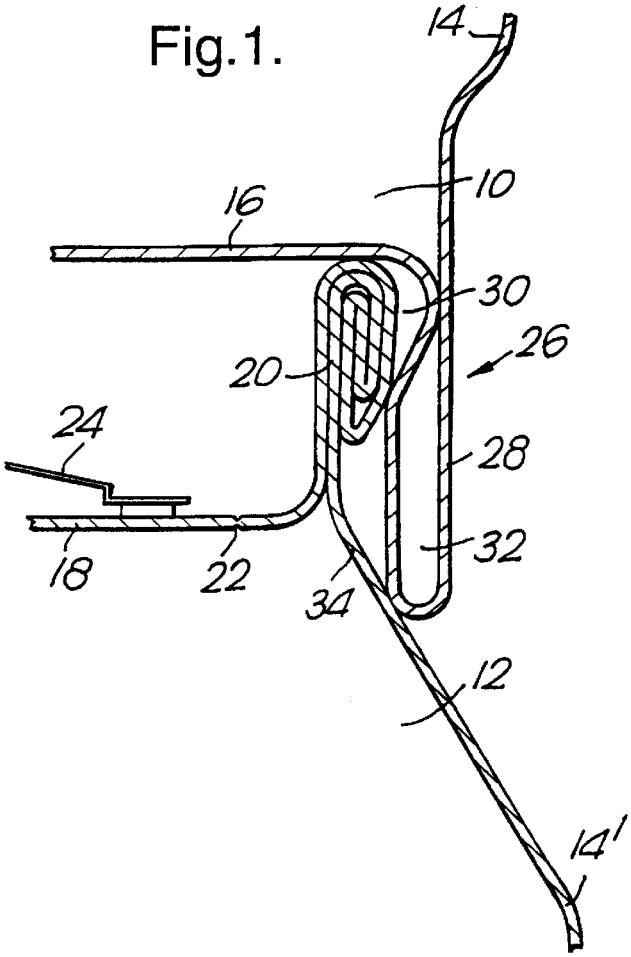
Figure 2:
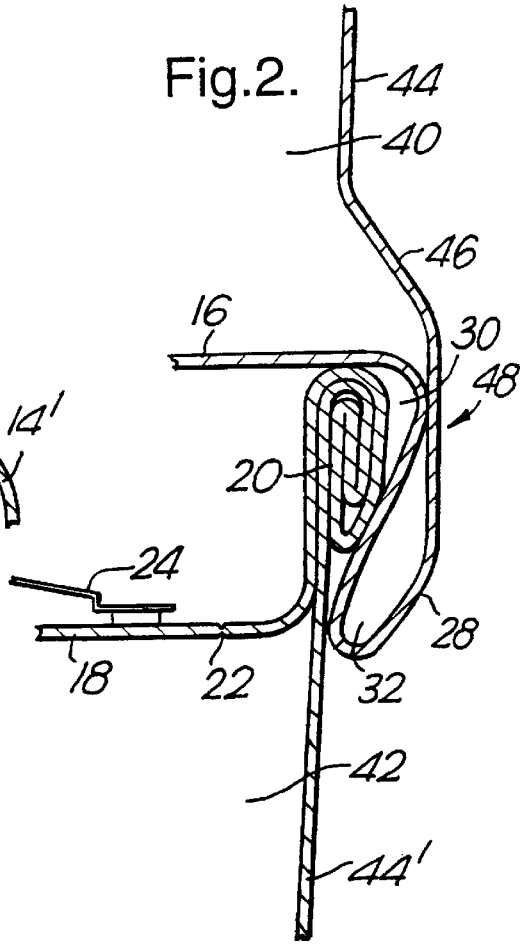

The invention will be further described by way of example, with reference to the drawings in which:

FIG. 1 shows a schematic partial section through two stacked cans according to one embodiment of the invention, slightly exploded; and FIG. 2 shows a schematic partial section through two stacked cans according to another embodiment of the invention.

DESCRIPTION OF A PREFERRED EMBODIMENT

FIG. 1 shows part of a top can 10 and a bottom can 12. It will be appreciated that the upper end of the top can (not shown) has the structure of the upper end of the bottom can and that the lower end of the bottom can (not shown) has the structure of the lower end of the top can.

The cans 10,12 are cylindrical, each having a cylindrical side wall 14,14' continuous with a base 16. The top of each can is sealed by a lid 18 joined to the upper end of the side wall 14' by a sealing rim 20. The rim 20 is formed by folding together the edge of the lid 18 and the upper edge of the side wall 14'. This means that the rim 20 bulges radially outward. The lid is a ring pull lid, having circumferential line of weakness 22 just inside the rim 20. A conventional ring pull 24 is attached to the lid 18.

A skirt 26 extends around the circumference of the base 16. It is formed by a downward extension 28 of the side wall 14 which doubles back up toward the base 16. As it doubles back, the wall approaches the downward extension 28 before continuing as the base 16 to define a channel 30 in the inward facing side of the skirt 26 and to provide a bulbous nose 32 at the lower end of the skirt.

The upper end of the cans is necked by a shoulder 34 from which extends upwards and slightly outwards the sealing rim 20; the free end of the rim is of slightly greater diameter than the end joined to the side wall 14' and the lid 18.

To stack the cans 10,12, the top can 10 is placed on the lower can 12 so that the bulbous nose 32 of the skirt 26 of one can impinges on the free end of the rim of the other can. The cans are urged together and the skirt 26 resiliently deforms out and over the end of the rim 20. Once the bulbous nose 32 of the skirt has passed over the free end 20 of the rim, it resumes its previous configuration to clip over the rim 20, locking the cans together. The rim 20 of the bottom can 12 interlocks with the channel 30 in the skirt 26 of the top can 10; this helps secure the cans together. The base 16 of the top can 10 rests on the free end of the rim 20 and the bottom of the skirt 26 of the top can rests on the shoulder 34 of the bottom can 12. In an alternative embodiment, the rim 20 is high enough for the base 16 to rest on the rim of the can 12 below, but the skirt 26 is not long enough to reach as far as the shoulder 34 of the can 12 below. In another embodiment, the skirt 26 of the top can 10 is long enough to rest on the shoulder 34 of the can 12 below, but the rim 20 is insufficiently high for the base 16 of the top can 10 to rest on it. In the case of ring pull cans, it is important that the base 16 of the top can does not bear on the ring pull 24 of the bottom cans, since this could cause the line of weakness 22 on the lid 18 to fail.

The dimensions and positions of the skirt 26 and rim 20 are chosen so that they are a friction fit as well as a resilient fit.

FIG. 2 shows a top can 40 and a bottom can 42 according to a second embodiment of the invention. In most respects, the cans 40,42 are similar to the cans 10,12 of the first embodiment shown in FIG. 1, and like reference numerals have been used to represent like parts. However, the side walls 44 of the can is flared out at its lower end by a shoulder 46. The skirt 48 is formed by a downward extension of the side wall 44 from the outer, lower end of the shoulder 46. It is similar to the skirt 26 of the embodiment of FIG. 1, but is shaped to curve around the rim 20 of a can and rest on the upper side wall 44', immediately below the rim.

Once clipped together, several cans can be picked up together by picking up the top can. A sharp tug at an angle to the principal axis of the cans will separate them.

It is envisaged that the cans will be stacked shortly after filling and sealing, so that they are further processed as a stack. Normally, several small cans, such as two 200 g cans or four 100 g cans, will be stacked and processed as if they were a single 400 g can. At this stage, the cans will normally be of a single variety of product.

It should be noted that as the stack passes through a retort, water may collect in the spaces between the cans. It may therefore be necessary to separate the cans forming the stacks and dry them in a conventional manner. New stacks can then be made which need not have the same constitution as the previous stacks.

The stacks of cans can be labelled in a single operation, separate labels being applied to each can in a stack. Since the cans are a friction fit with each other, there is no relative rotation of cans within a stack; thus, the labels remain in the alignment in which they are applied. This has particular advantage when a stack is composed of different varieties of one type of product; similar labels can be used for each variety, the corresponding parts of each label being in and remaining in alignment from can to can within the stack.

It will be seen that the present invention provides a can which has significant advantages in ease of processing, transport and at retail sale compared with conventional cans.

What is claimed is:

1. A container having a lid with a substantially peripheral rim, a base, a side wall and a generally peripheral skirt around the base extending away from the container body to resiliently fit over the rim of another similar container wherein the rim and the skirt are shaped to interlock when the skirt of one container is resiliently fitted over the rim of another similar container.

2. A container according to claim 1 wherein the side wall is necked at the lid end so that the rim lies inside the perimeter defined by the side wall.

3. A container according to claim 1 wherein the lower portion of the container flares outwardly.

4. A container according to claim 1 wherein the skirt is continuous.

5. A container according to claim 1 wherein the skirt defines a channel on its inward facing side.

6. A container according to claim 1 wherein the side wall is generally circularly cylindrical.

7. A container according to claim 1 wherein the rim is a seal between the lid and the side wall.

8. A container according to claim 1 wherein the skirt of one container is a friction fit with the rim of another container when one container is fitted over another container.

9. A container according to claim 1 wherein the rim extends generally upwardly and outwardly from the lid.

10. A container according to claim 1 wherein the container is a can wherein the side wall and base are integral.

11. A can according to claim 10 having a ring pull opening lid.

12. A can according to claim 11 wherein the skirt extends away from the container body a distance such that when the skirt of one can is fitted over the rim of another similar can in a stack of at least two cans the base of said one can does not impinge on the ring pull on the lid of the said another can.

13. A container as defined in claim 1 wherein at least two containers are formed into a stack of containers.

14. A stack according to claim 13 wherein the stack of containers comprises containers of at least two different sizes.

15. A stack according to claim 13 wherein the stack of containers comprises at least two different types of containers.

* * * * *